US006038982A

United States Patent [19]

Witzig

[11] Patent Number: 6,038,982

[45] Date of Patent: Mar. 21, 2000

[54] TABLE WITH A HEIGHT-ADJUSTABLE TABLETOP PART

[75] Inventor: Uli Witzig, Wolfhausen, Switzerland

[73] Assignee: Provenda Marketing AG, Rehetobel, Switzerland

[21] Appl. No.: 09/208,128

[22] Filed: Dec. 9, 1998

[30] Foreign Application Priority Data

Dec. 29, 1997 [EP] European Pat. Off. ..... 97811030

[51] Int. Cl.[7] ..... A47F 5/12

[52] U.S. Cl. ..... 108/3; 108/145

[58] Field of Search ..... 108/3, 1, 7, 9, 108/10, 145, 144.11, 147

[56] References Cited

U.S. PATENT DOCUMENTS

| | | | |
|---|---|---|---|
| 8,486 | 11/1851 | Hammitt | 108/3 |
| 689,707 | 12/1901 | Davis | 108/3 |
| 2,170,098 | 8/1939 | Stephenson | 108/145 X |
| 2,223,405 | 12/1940 | Cain | 108/3 |
| 3,802,002 | 4/1974 | Jonas | 108/147 X |
| 5,199,360 | 4/1993 | Koistinen | 108/3 |
| 5,694,864 | 12/1997 | Langewellpott | 108/145 |

FOREIGN PATENT DOCUMENTS

| | | | |
|---|---|---|---|
| 117 419 | 12/1929 | Austria . | |
| 2571234 | 4/1986 | France | 108/145 |
| 63 634 | 11/1891 | Germany . | |
| 75 228 | 10/1893 | Germany . | |
| 33 007 | 11/1964 | Germany . | |
| 27 31 673 | 1/1979 | Germany . | |
| 225 533 | 5/1943 | Switzerland . | |
| 346 673 | 7/1960 | Switzerland . | |
| 429 063 | 7/1967 | Switzerland . | |
| WO 90 03133 | 4/1990 | WIPO . | |

*Primary Examiner*—Jose V. Chen
*Attorney, Agent, or Firm*—Frishauf, Holtz, Goodman, Langer & Chick, P.C.

[57] ABSTRACT

In a table (11), the tabletop (19) is divided into three parts (21, 22, 23), of which one (23) is fixedly connected to the frame (13) of the table (11), the second (22) is articulated on the first (23) by a joint (27) and the third (31) is in turn articulated on the second (22) by joint (25) and is adjustable as to height. Together with an arm (29) pivotally fixed on the frame (13) and on the height-adjustable tabletop part (21), the movable tabletop part (22, 21) and the frame (13) form a parallelogram. The angle α of the parallelogram is adjustable with a lever (31) on the middle tabletop part (22) and by a motor (33) with a spindle (35). The height of the table is thus adjustable.

12 Claims, 1 Drawing Sheet

TABLE WITH A HEIGHT-ADJUSTABLE TABLETOP PART

FIELD OF THE INVENTION

The invention relates to a table having a frame beneath a sub-divided tabletop, one tabletop part being articulated to at least one pivoting part and thus being adjustable in height, and said pivoting part is formed by another part of the tabletop.

BACKGROUND OF THE INVENTION

In conference rooms or auditoria there is not only a need for tables at normal height, but also for table surfaces at lectern height. Taller table surfaces are required, for example, as a shelf surface to accommodate a script in the case of a lecture given in a standing position, as a surface for a projector, or also simply to enable something to be placed thereon so as to be readily visible. In addition, different table heights are required, as a rule, in the form of table surfaces adjacent the normal-height tables.

Swiss patent specification No. 225 533 discloses a flat desk which can be converted to a draftsman's desk, comprising a desk tabletop provided with hinged feet. The latter are articulated to the desk tabletop at one end and to a top part of the flat desk at the other end. The desk tabletop is raised in the rear region by unfolding the feet. To place the desk tabletop in a horizontal position two hinged transverse supports are provided. It has a disadvantage that a gap forms between the raised tabletop part and an adjacent stationary tabletop, and articles on the table can fall into this gap. Also, the raised tabletop can only be aligned horizontally at the height determined by the transverse supports and pivotable feet. Another disadvantage is that the tabletop is not continuously adjustable as to height.

WO 90/03133 discloses a table construction wherein a tabletop is divided into two by a joint, the first part being articulated on the support frame and the second part being articulated on the first part and hence being adjustable as to height with the pivoting of said first tabletop part. A lever parallelogram consisting of the two tabletop parts, the support frame, and a lever parallel to the pivotable tabletop part can be secured in different positions by a locking device.

A disadvantage of both these tables is that in each case only the height-adjustable part remains horizontal while the remaining tabletop surface is inclined. It is, therefore, impossible to have articles lying on one part of the table surface while another part is adjusted as to height. No adjacent shelf surfaces with different table heights can be obtained with such a table.

SUMMARY OF THE INVENTION

It is, therefore, an object of the invention to provide a table which, depending on the user's requirements, can optionally have a tabletop with all of it being at the same height or a tabletop at normal height with a part of the surface raised from that height. The height of the liftable table surface should preferably be adjustable continuously. Also preferred is an elegant solution in which the mechanism may be visible and yet does not have an aesthetically displeasing appearance.

This and other objects are attained in accordance with one aspect of the invention which is directed to a table having a frame beneath a sub-divided tabletop. One tabletop part is articulated to at least one pivoting part to be adjustable in height. The pivoting part is formed by another part of the tabletop. A third tabletop part is secured to the frame so as to be fixed and stationary, with the pivoting part being the middle tabletop part.

By pivoting of the pivoting part, this part of the tabletop is inclined and the height-adjustable tabletop part is raised at least on one side, for example to lectern height or even higher. Without an additional support on the height-adjustable tabletop part, the latter is inclined by the pivoting of the pivoting part. The height adjustment is limited by the width of the pivotable tabletop part.

If the pivotable tabletop part forms a single pivoting part extending from one table edge to another, the table has the advantage that no opening forms between the pivoting part and the height-adjustable tabletop part, and the tabletop part which remains fixed does not pass beneath the height-adjustable tabletop part.

Advantageously, at least one pivotable arm is disposed on the frame and the height-adjustable tabletop part, the pivoting part, the frame and the pivotable arm are interconnected pivotally after the style of a parallelogram.

As a result, the entire height-adjustable tabletop part can be adjusted in height by varying an angle of this quadrilateral. If the quadrilateral is a parallelogram, the height-adjustable tabletop part also moves in parallel relationship.

This raising and lowering of the height-adjustable tabletop part can be effected manually. Advantageously, however, a motor is disposed beneath the tabletop, by means of which the angles of the parallelogram can be varied via a lever to raise or lower the height-adjustable tabletop part. For this purpose, for example, a spindle is disposed on the motor and a nut on the lever. The lever is advantageously disposed on the pivotable arm or on the pivotable tabletop part.

Preferably, the at least one pivotable tabletop part is articulated on the fixed tabletop part so that the three tabletop parts are interconnected by two joints. As a result, the tabletop remains cohesive irrespective of the position of the adjustable tabletop part.

Although there is no need for the axes of the two joints between the three tabletop parts to extend in parallel, a parallel configuration is preferred. In the case of non-parallel axes the height-adjustable tabletop part assumes an inclined position in relation to the fixed tabletop part, this inclination increasing with the height.

In one preferred embodiment, the axes extend in parallel relationship but not orthogonally to the table edges, so that with a rectangular basic shape of the table a trapezoidal part of the table remains fixed, a parallelogram-shaped part forms the pivoting part or intermediate part, and another trapezoidal part is constructed as a height-adjustable tabletop part. As a result, the height-adjustable tabletop part performs a movement transversely to the table edge simultaneously with the lifting or lowering movement. This movement can be rendered possible by making the axes of the joints between the tabletop parts parallel to the axes between the support frame and the movable arm or between the latter and the height-adjustable tabletop part. In other words, the axes in the parallelogram must all extend in parallel relationship. However, if one set of axes extends orthogonally, while the others are at an oblique angle to the table edges, the height-adjustable tabletop part can be mounted for displacement also in the joint between the height-adjustable tabletop part and the movable arm. In this way the transverse displacement of the height-adjustable tabletop part can also take place.

Advantageously, the axes of the two joints between the tabletop parts are situated within the tabletop. As a result, there are no joints to open or close between the table top parts on the movement of the lectern part. Particularly if the tabletop parts are inter-toothed and form hinges in the teeth, the table-top remains uninterrupted even in the hinges.

Advantageously, the axes of the joints between the support frame and movable arm and between the latter and the tabletop are situated beneath the latter. They are therefore invisible. The table is advantageously on castors.

Advantageously, the position of one of the joint axes between the support frame and the arm or between the latter and the height-adjustable tabletop part is variable with respect to one of the three parts involved, so that the inclination of the height-adjustable tabletop part is variable.

BRIEF DESCRIPTION OF THE DRAWING

One embodiment of the invention will be described hereinbelow with reference to the single FIG. 1 which shows an elevational view.

DETAILED DESCRIPTION OF THE PREFERRED EMBODIMENT

Figure 1:
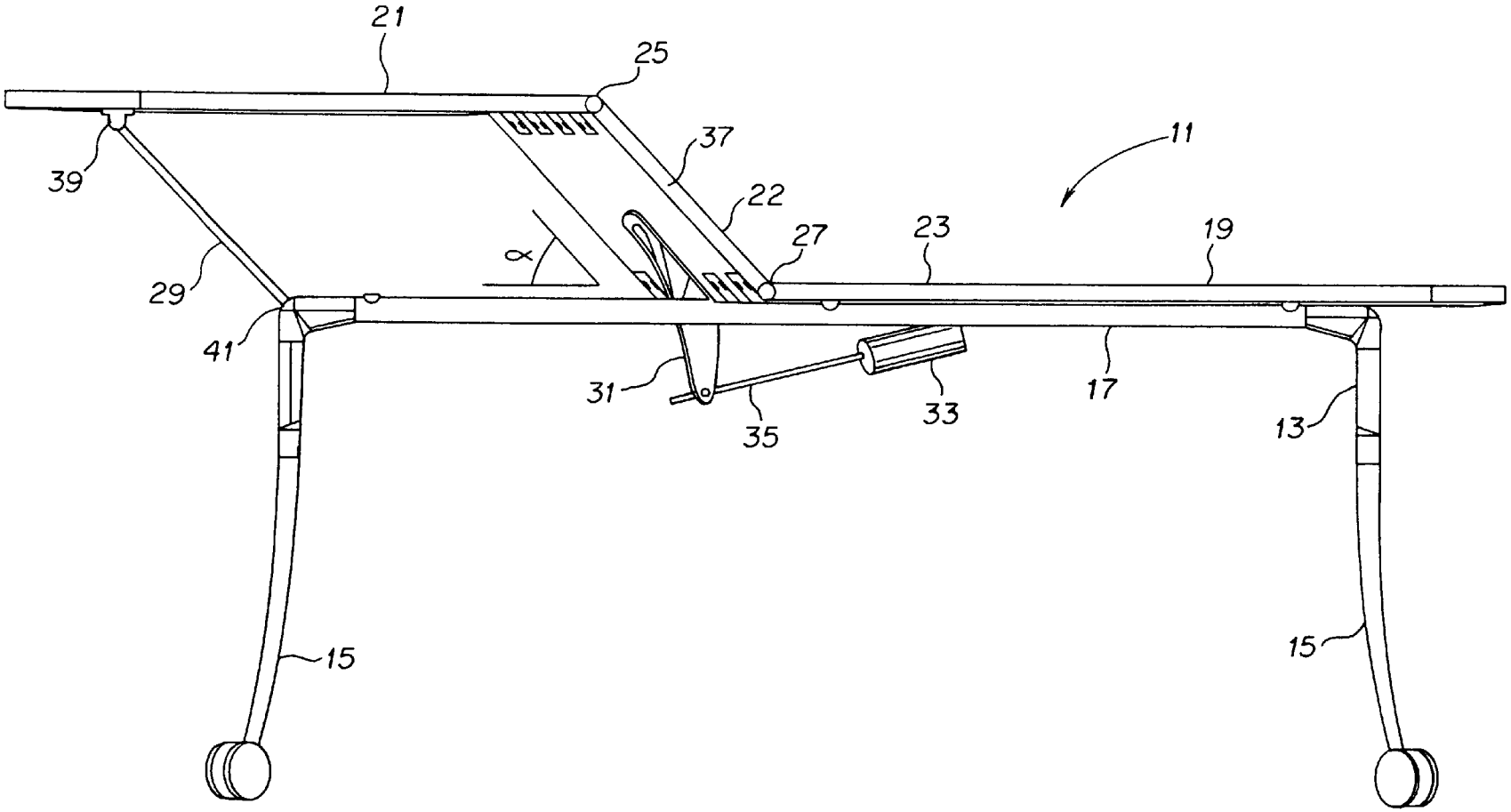

The stepped table 11 comprises a support frame 13 with four legs 15 and horizontal members 17. The tabletop 19 rests on the frame 13. The tabletop 19 comprises three tabletop parts 21, 22, 23, of which the parts 21 and 22, and also the parts 22 and 23, are connected by hinges 25 and 27 respectively. The tabletop part 23 is fixed on the support frame 13. The tabletop part 21 is pivotally connected by a pivotable arm 29 to a horizontal member 17, said arm 29 and the middle tabletop part 22 being aligned in parallel in the projection perpendicular to the longitudinal edge of the table 11. As a result, the tabletop part 21 is adjustable in height, the arm 29 and the middle tabletop part 22 being pivoted.

To pivot the tabletop part 22 and hence adjust the height of the tabletop part 21, a lever 31 is disposed on the middle pivotable tabletop part 22 and to it is attached a spindle 35 driven by a motor 33. The motor 33 is pivotally mounted. Rotating the spindle increases or reduces the distance between the lever 31 and the motor. As a result, the lever 31 is pivoted and the tabletop part 21 is lifted or lowered. At the same time the motor 33 and the spindle 35 are pivoted.

Since the hinges 25 and 27 are not aligned orthogonally to the longitudinal edges of the tabletop 19 and of the support frame 13, the tabletop part 21 also moves laterally during lifting. This movement corresponds to the deviation of the table edge 37 of the middle part 22 from the vertical and is therefore dependent on the deviation of the hinge direction to the perpendicular to the table edge 37 and on the pivoting angle $\alpha$ between the support frame 13 and the tabletop part 22. To accommodate this movement in the horizontal direction, the arm 29 must either be mounted for lateral displacement or its pivot axes must be aligned parallel to the axes of the hinges 25 and 27. The arm 29 is mounted pivotally on a spindle 41 on the support frame 13 and pivotally and displaceably on a spindle 39 on the tabletop part 21.

I claim:

1. A table, comprising:

a tabletop which is sub-divided into a fixed tabletop part, a height-adjustable tabletop part, and a pivoting tabletop part between the fixed and height-adjustable tabletop parts, a support frame, said fixed tabletop part being secured to said support frame, said pivoting tabletop part having one end pivotally coupled to one of the support frame and the fixed tabletop part, and another end pivotally coupled to one end of said height-adjustable tabletop part.

2. The table according to claim 1, wherein the tabletop has at least two opposed longitudinal edges extending from one end of the table to another end of the table, said fixed tabletop part being at one end of the table and said height-adjustable tabletop part being at the other end of the table.

3. The table according to claim 2, wherein said pivoting tabletop part is a single piece extending from one of said two edges to the other.

4. The table according to claim 2, further comprising a pivotable arm having opposed ends pivotally coupled, respectively, to said support frame and to another end of said height-adjustable tabletop part, whereby said pivoting tabletop part, said support frame, said height-adjustable tabletop part, and said pivotable arm form a parallelogram.

5. The table according to claim 4, further comprising a motor disposed beneath said tabletop, and a lever operatively coupled between said motor and one of said pivoting tabletop part and said pivotable arm, whereby the height-adjustable tabletop part is raised or lowered as a pivoting angle between said pivotable tabletop part and said fixed tabletop part increases or decreases.

6. The table according to claim 4, wherein said pivoting tabletop part is pivotally coupled to said fixed tabletop part.

7. The table according to claim 6, wherein a first pivot axis between said fixed tabletop part and said pivoting tabletop part extends at an oblique angle to said longitudinal edges.

8. The table according to claim 7, wherein a second pivot axis between said height-adjustable tabletop part and said pivoting tabletop part is parallel to said first pivot axis.

9. The table according to claim 8, wherein said tabletop has a selected thickness and wherein said first and second pivot axes are situated within the thickness of said tabletop.

10. The table according to claim 8, wherein third and fourth pivot axes are between said opposed ends of the pivotable arm and, respectively, said support frame and said other end of the height-adjustable tabletop part, said third and fourth pivot axes being orthogonal to said edges, and said pivotable arm being mounted for lateral displacement on at least one of said third and fourth pivot axes.

11. The table according to claim 10, wherein said third and fourth pivot axes are situated beneath the tabletop.

12. The table according to claim 10, wherein at least one of said third and fourth pivot axes are selectively positionable relative to at least one of said support frame, said pivotable arm and said height-adjustable tabletop part to thereby vary inclination of said height-adjustable tabletop part relative to said support frame.

* * * * *